US006041575A

United States Patent [19]

Vonderhorst et al.

[11] Patent Number: 6,041,575

[45] Date of Patent: Mar. 28, 2000

[54] METHOD AND APPARATUS FOR APPLYING ARTICLE TO INTERIOR SURFACE OF FLEXIBLE PACKAGE

[75] Inventors: James P. Vonderhorst, Parkton; William M. Berg, Fallston, both of Md.

[73] Assignee: Exact Packaging, Inc., New Freedom, Pa.

[21] Appl. No.: 09/184,983

[22] Filed: Nov. 3, 1998

[51] Int. Cl.[7] ..... B65B 61/00

[52] U.S. Cl. ..... 53/415; 53/135.3; 53/157; 53/451; 53/551

[58] Field of Search ..... 493/297, 302, 493/375, 380, 382; 53/155, 157, 128.1, 135.1, 135.2, 135.3, 410, 415, 450, 451, 550, 551, 552

[56] References Cited

U.S. PATENT DOCUMENTS

| | | | |
|---|---|---|---|
| 3,289,386 | 12/1966 | Farmer . | |
| 3,381,442 | 5/1968 | Paxton | 53/410 |
| 4,533,425 | 8/1985 | Wehle | 493/302 X |
| 4,547,250 | 10/1985 | Murayama . | |
| 4,709,528 | 12/1987 | Merkus | 53/551 X |
| 4,726,171 | 2/1988 | Kreager et al. . | |
| 4,765,118 | 8/1988 | Akutsu et al. | 53/551 X |
| 4,779,397 | 10/1988 | Christine et al. | 53/410 |
| 4,897,273 | 1/1990 | Kotaki et al. | 53/451 X |
| 4,907,393 | 3/1990 | Omori et al. | 53/410 |
| 5,014,493 | 5/1991 | West | 53/410 |
| 5,031,380 | 7/1991 | Ueda | 53/552 X |
| 5,084,290 | 1/1992 | Morita et al. | 53/410 X |
| 5,224,583 | 7/1993 | Palmaer et al. . | |
| 5,298,104 | 3/1994 | Absher . | |
| 5,330,777 | 7/1994 | Mize, Jr. et al. . | |
| 5,369,936 | 12/1994 | Callahan et al. . | |
| 5,390,475 | 2/1995 | Iwauchi et al. | 53/428 X |
| 5,467,581 | 11/1995 | Everette | 53/450 X |
| 5,511,358 | 4/1996 | Morita et al. | 53/449 X |
| 5,759,337 | 6/1998 | Fujio et al. . | |

*Primary Examiner*—Daniel B. Moon
*Attorney, Agent, or Firm*—Nixon Peabody LLP; Tim L. Brackett, Jr.

[57] ABSTRACT

A method and apparatus for applying an article to the interior surface of a flexible package is provided which includes the application of articles to a flexible web of packaging material at a point along a web feed path which minimizes the likelihood of article separation downstream. Specifically, the present method and apparatus includes a driving system for pulling a web of material through a feed path, a tube former having an inlet positioned along the feed path for receiving the web of material and an article applicator for applying articles onto an interior package surface of the web of material at the inlet of the tube former. In this manner, the article is delivered to the web downstream of the upper edge of the tube former thereby minimizing inadvertent separation of the article from the web as experienced in conventional machines as the web passes over the upper edge of the tube former. The present method and apparatus advantageously utilizes a receiving gap formed in the tube former and a guide wall for guiding and assisting in the application of the label as the tube is formed. Accordingly, the present method and apparatus more reliably and accurately apply an article to a web surface and form a package having an interior surface with the article attached thereto.

18 Claims, 3 Drawing Sheets

METHOD AND APPARATUS FOR APPLYING ARTICLE TO INTERIOR SURFACE OF FLEXIBLE PACKAGE

TECHNICAL FIELD

The present invention relates to an apparatus and a method for applying articles such as coupons, labels, premiums and the like to the interior surface of a flexible package, such as a bag, for containing a product.

BACKGROUND OF THE INVENTION

The application of articles, such as labels and coupons, to product packages has been and continues to be an important step in providing product identification, specific product information and marketing advantages. Manufacturers of various products are continually seeking a more efficient and effective manner in which to apply articles to product packages, such as cartons, containers or any other packages having a surface capable of securely receiving an adhesive article.

Specifically, many systems have been developed for applying an article to the exterior surface of a package. For example, U.S. Pat. No. 5,298,104 to Absher discloses an apparatus for applying individual coupons to the exterior surface of a web of material used to form flexible bags. The coupons are blown or pressed onto the web material upstream of a bag forming device. The web then travels to the bag forming device which forms a bag having the label attached to the exterior surface. Likewise, U.S. Pat. No. 5,369,936 to Callahan et al. discloses a flexible bag forming apparatus which applies a detachable promotional banner or coupon to the exterior surface of the bag a spaced distance upstream of a tube forming device. The banner or coupon is a continuous web of material pressed onto the web of bag material. However, articles, such a coupons or labels, applied to the exterior of a package may disadvantageously be removed without accessing the contents of the package.

Consequently, other methods have been developed for positioning coupons and the like inside the package. Such methods include gravity-fed "pick-and-place" devices which places individual articles into a bag before, during or after introduction of the product into the bag. Articles placed into bags by "pick-and-place" machines generally reside freely within the bag, i.e. are not connected to the bag. The articles are therefore free to move around within the bag to positions which may be less than optimally located for maximum visibility by the consumer. Furthermore, with high speed packaging devices such as form-and-fill baggers for snack foods, pick-and-place machines may possess disadvantages such as slow operating speeds, as well as inconsistent and unpredictable article placement.

As a result, other systems have been developed for applying articles to the interior surface of a bag. For example, U.S. Pat. Nos. 3,289,386 to Farner and 4,726,171 to Kreager et al. disclose methods of making labeled packages including providing a label or coupon to the surface of a web of bag material formed into a tube by a tube former. The tube former includes an upper edge having an angled shape over which the web material passes. The tube is then sealed, filled and cut to form a bag having a label on the interior surface. However, the system disclosed by Farmer applies a continuous strip of labels to the continuous web of bag material. Also, the Kreager et al. system applies the individual articles, e.g. labels or coupons, to the web at a location along the web feed path a substantial distance upstream of the tube former.

Consequently, there is a need for an apparatus and a method for applying articles such as coupons, labels and premiums, such as condiments, to the interior surface of a flexible package, such as a bag, which ensures accurate and secure article placement while maintaining effective bag formation.

SUMMARY OF THE INVENTION

It is an object of the present invention, therefore, to overcome the disadvantages of the prior art and to provide an article applying apparatus for reliably and accurately forming a package and applying an article to an interior surface.

Another object of the present invention is to provide an article applying apparatus which permits a variety of shapes, sizes and types of articles to be effectively applied to the interior surface of a package.

Yet another object of the present invention is to provide an article applying apparatus which minimizes the costs associated with applying an article to an interior surface of a package.

Still another object of the present invention is to provide an article applying apparatus which ensures an article is maintained in secure contact with an interior package surface of a web during formation of a package.

A further object of the present invention is to provide an article applying apparatus which permits articles to be applied to various locations on an interior package surface of a package.

A still further object of the present invention is to provide an article applying apparatus which minimizes the likelihood that an article attached to a web of package material is dislodged during package formation.

Still another object of the present invention is to provide a method for applying an article to a package which achieves each of the objectives noted hereinabove.

These and other objects of the present invention are achieved by providing an article applying apparatus for applying an article to an interior package surface, comprising a driving system for pulling a web of material, having an interior package surface, through a feed path, a tube former having an inlet positioned along the feed path for receiving the web of material and an article applying device positioned adjacent the inlet of the tube former for applying articles onto the interior package surface of the web of material at the inlet of the tube former. The tube former includes an upper edge at least partially defining the inlet and the article applying device is positioned in a predetermined location relative to the upper edge to dispense articles onto the web of material at one of the upper edge and a location downstream of the upper edge.

The feed path may extend away from the upper edge in a predetermined tube forming direction and the article applying device may be positioned in a predetermined location to cause the articles to be delivered toward the inlet substantially in the predetermined tube forming direction. The article applying device may include a peeler bar having a peeling edge in close proximity to the inlet. Also, the peeler bar may be positioned in the predetermined location to form a spacing between the peeler bar and the upper edge less than an outer dimension of the article. Each of the articles may include a planar contact side for adhering to the interior package surface of the web of material. The feed path extends toward the upper edge in a first direction and the applying device may deliver the article to the inlet with the planar contact side generally transversed to the first direction. The article applying apparatus may further include an article guiding feature positioned opposite the upper edge of the tube former for guiding the article into contact with the web of material. The article guiding feature may be a guiding wall positioned opposite the upper edge to form a receiving gap for receiving the article.

The present invention is also directed to a method for applying an article to an interior package surface, comprising pulling the web of material through a feed path, providing a tube former having an inlet positioned along the feed path for receiving the web of material, applying an article to the interior package surface of the web at the inlet of the tube former, and forming the web of material into a tube with the article attached to the interior package surface. The method preferably includes a step of sealing a portion of the tube to form a bag. In addition, the feed path extends away from the tube former in a predetermined tube forming direction. The method may include the step of providing and positioning an article dispenser in a predetermined location adjacent the tube former to cause articles to be delivered toward the inlet substantially in the predetermined tube forming direction. Preferably, the articles are mounted on a continuous strip of backing material and the method further includes the steps of providing an article applicator and pulling the strip of backing material through the applicator to cause the articles to be dispensed from the strip of backing material. The method may further include the step of pulling the web of material at a faster feed rate than a feed rate of the strip of backing material to cause each article adhering to the web of material to be pulled from the strip of backing material by a pulling force of the web of material on the article. Also, the method may include the step of positioning the article applicator in the predetermined location to form a spacing between the article applicator and the tube former less than an outer dimension of the article. dr

DETAILED DESCRIPTION OF THE PREFERRED EMBODIMENT

Figure 1:
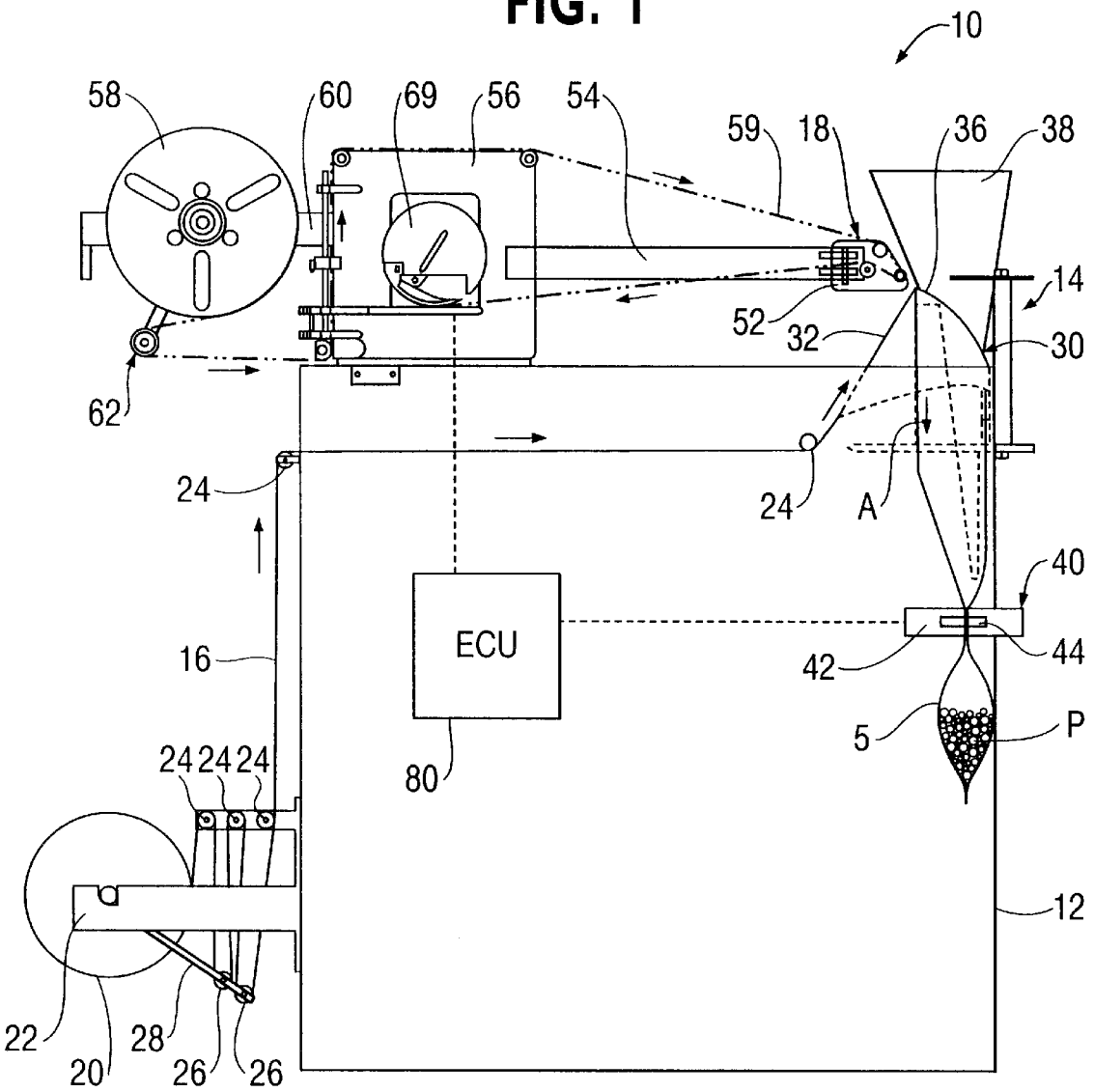
FIG. 1 is a front elevational view of the article applying apparatus of the present invention.

Referring to FIG. 1, there is shown the article applying apparatus of the present invention, indicated generally at 10, for forming a package from a flexible web of material and applying an article to an interior package surface. Article applying apparatus 10 generally includes a support frame 12, a form-fill-seal device 14 mounted on support frame 12 for effecting the forming and filling of the flexible package, a supply of a continuous web of flexible package-forming material 16 and an article applicator 18. The article applying apparatus, that of the present invention, combines these components in such a manner as described more fully hereinbelow to permit the formation of a flexible package having an article more effectively and securely attached to its interior surface by a simple and cost effective method.

Referring to FIG. 1, the continuous web of package-forming material is supplied in the form of a roll of material 20 rotatably mounted on a support arm 22 secured to support frame 12. The web of material is fed around idle rollers 24, dancer rollers 26 and through a feed path for delivery to form-fill-seal device 14. Dancer rollers 26 are mounted on a dancer arm 28 pivotally biased to maintain appropriate tension in the web feeding from roll 20. Of course, it should be understood that any combination of idle rollers and dancer rollers could be used which effectively permit sufficient web material to be fed from the supply roll while maintaining the appropriate tension in the web along the feed path. For example, a constant or variable tensioning device may be used.

Figure 2:
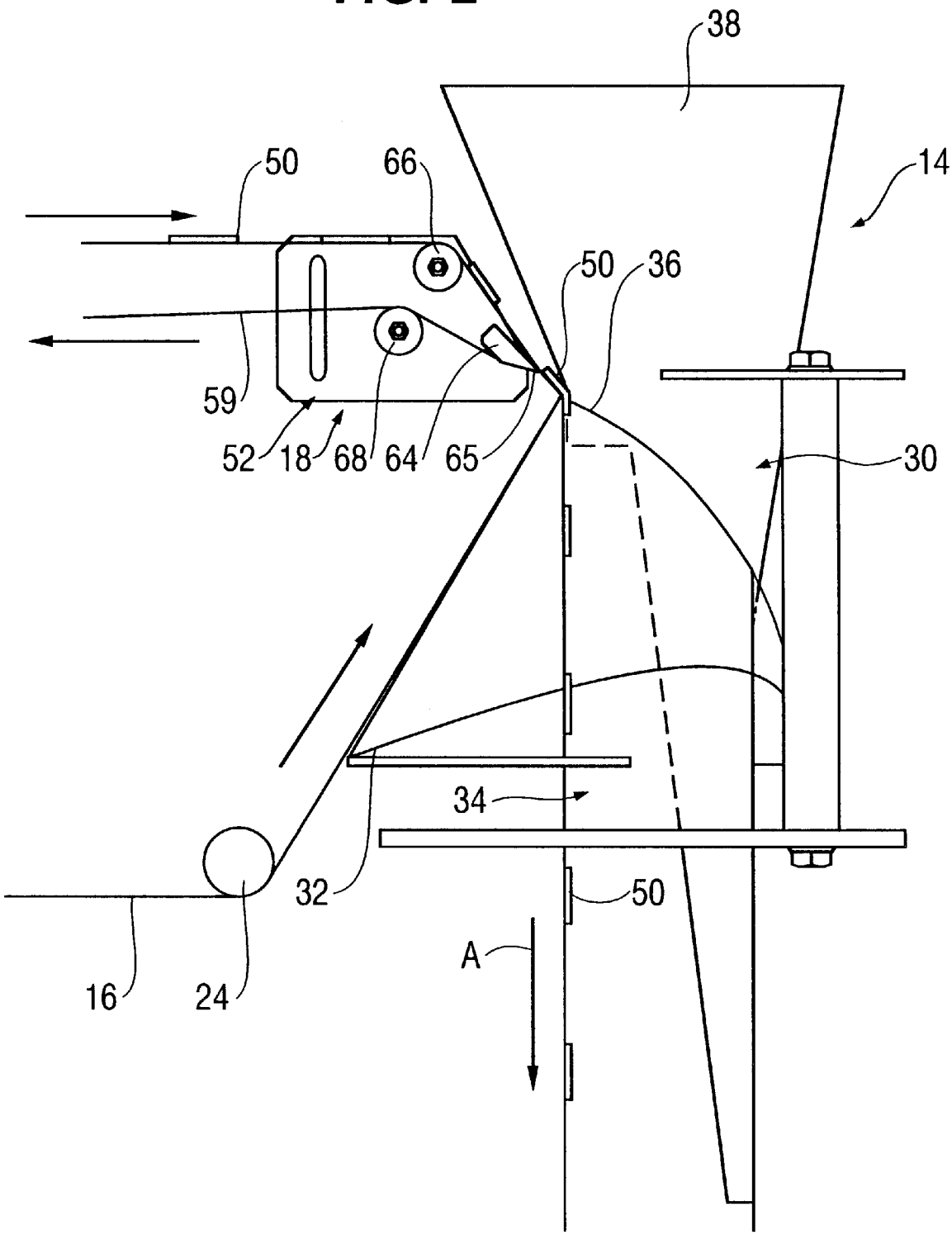
FIG. 2 is an enlarged elevational view of the applicator and tube former sections of the apparatus of the present invention.
Figure 3:
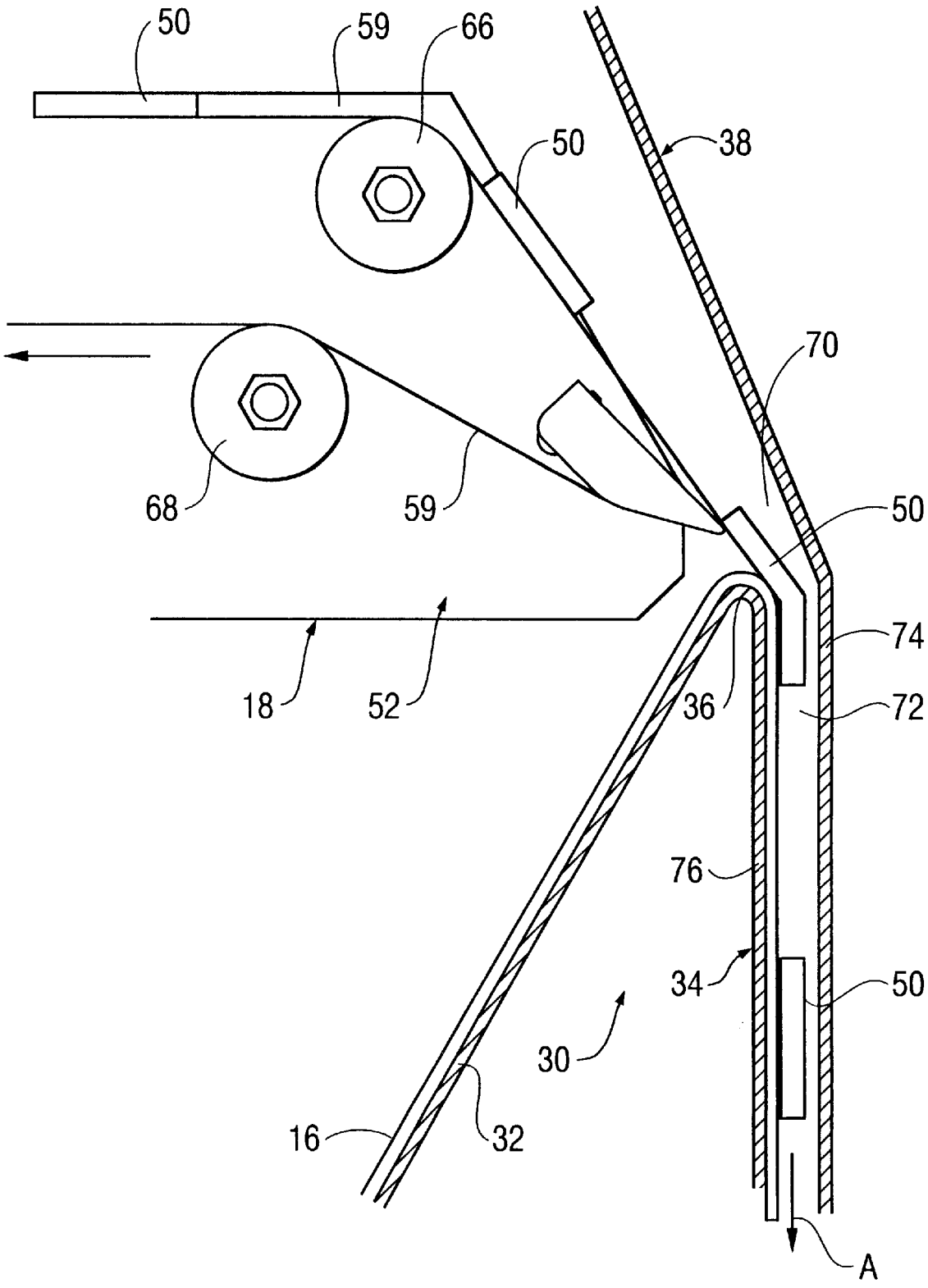
FIG. 3 is an enlarged cross-sectional view of the tube former of FIG. 2 showing the application of the articles to the web by the applicator.

Referring to FIGS. 2 and 3, form-fill-seal device 14 includes a tube former 30 comprised of a skirt portion 32 and a cylindrical portion 34 connected by an upper edge 36. Skirt portion 32 and cylindrical portion 34 act in concert to wrap the incoming web of packaging material around cylindrical portion 34 and thereby create a hollow, tubular package preform. Form-fill-seal device 14 also includes a funnel portion 38 positioned in the upper end of cylindrical portion 34 and extending into cylindrical portion 34 as clearly shown in FIGS. 2 and 3. As described hereinbelow, product is introduced into the tube via funnel portion 38 to fill a portion of the tubular preform having a sealed end prior to completely sealing the package. In that regard, form-fill-seal device 14 also includes a tube sealer 40 comprised of sealing and advancing jaws 42 between which the tubular preform is positioned. Sealing and advancing jaws 42 close to seal the tubular preform by, for example, heat sealing, thereby completely sealing a package 5 while simultaneously sealing the bottom end of the tubular preform in preparation for filling and then sealing another end to form a filled package. In addition, sealing and advancing jaws 42 move downwardly when in the closed position to pull additional web material over upper edge 36 and through cylindrical portion 34 in a tube forming direction as indicated by arrow A. The longitudinal or 'back' seal of the preform is created by a sealing device (not shown) to provide a typical form-seal or lap-seal configuration. Thus, sealing and advancing jaws 42 transversely seal the tubular preform by heat sealing or welding and crimping the flexible package material. Typically, the web is formed of a thermal plastic polymeric bag-making film material easily sealed by heat and pressure. Of course, any conventional sealing device capable of effectively creating a seal along the transverse width of the tubular preform could be utilized. A cutting device 44 is integrated into the sealing and advancing jaws 42 for severing the package transversely along the sealing area while maintaining a seal on opposite sides of the cutting device thereby releasing a completed package 5.

It should be noted that the device for grasping and advancing the tubular preform may be any device typically used in this technology in place of the sealing and advancing jaws 42. That is, the sealing and advancing jaws may be used only to seal the tubular preform while a separate grasping and advancing device is used to pull the preform. For example, an advancement device, positioned adjacent the tubular preform, may include a pull belt and pulley arrangement. In a conventional manner, the pull belt grasps the package preform along its sides, pulling is downward along cylindrical portion 34. Generally, such an apparatus includes a pair of endless belts, with each belt arranged around a pair of pulleys. Each belt and set of pulleys are placed opposite to another belt and set of pulleys on one side of the forming and filling tube. The belts are typically engaged with the tubular preform by a vacuum system which acts to draw the preform into contact with the belt. The belts are operated intermittently so that the preform is advanced (index) along the tube at lengths which coincide with the desired length of the finished package, e.g. bag.

Importantly, the present invention includes the application of articles 50 onto the web of flexible packaging material at a location along the feed path of the web of material which minimizes the likelihood of, and opportunity for, subsequent separation of the article from the web thereby ensuring a secure and reliable article attachment. Specifically, in the present embodiment, article applicator 18 includes a peeler bar assembly 52 for dispensing and at least partially applying articles 50 to the web of packaging material. Peeler bar assembly 52 is mounted on an extension arm 54 fixed to a driver housing 56 positioned on support frame 12. A supply roll 58 of articles affixed to a continuous strip of backing material 59 is rotatably mounted on an arm 60 extending from driver housing 56. A dancer arm and roller assembly 62 and idle rollers 64 are positioned for directing the strip of articles, i.e. labels, toward article applicator 18. As shown in FIG. 2, peeler bar assembly 52 includes a peeler bar 64, an inlet guide roller 66 and an outlet guide roller 68 for guiding the strip of articles to and from the peeler bar, respectively. Peeler bar 64 functions in a conventional manner to provide a peeling edge 65 over which the backing strip is bent to cause the less flexible label to separate from the backing strip for application to the web of packaging material. A take-up and drive drum 69 is mounted on a rotatable shaft of a motor (not shown) which operates to rotate drum 69 in a clockwise direction as shown in FIG. 1 for accumulating the waste backing material into a roll.

In the present embodiment, as shown in FIGS. 2 and 3, articles 50 are in the form of labels precut and releasibly mounted on the backing strip of material in a spaced arrangement along the length of the strip. However, the present invention could be practiced with practically any article capable of being introduced into tube former 30, such as packets of premiums and/or condiments. The invention further relates to the application of articles comprised of atmosphere-modifying agents including desiccants, fragrance or flavor ingredients or enhancers, oxygen level reducers, oxygen gas replacers or tamper indicators which, for example, change color when the bag is opened. In addition, article applicator 18 may be any other form of applicator device capable of effectively delivering articles 50 to an inlet of tube former 30 as discussed hereinbelow. For example, article applicator 18 may include a conveying applicator which moves one or more dispensed articles from a source to the tube former. For example, article applicator 18 may be in the form of a vacuum type delivery assembly which moves from, for example, a peeler bar assembly positioned a spaced distance from the tube former to deliver dispensed articles onto the web at the tube former.

Importantly, the apparatus and method of the present invention operate to apply articles to the web of package material at a location along the feed path which minimizes the tendency of the articles to become dislodged from the web. Specifically, an inlet 70 is formed around the circumference of form-fill-seal device 14 between upper edge 36 of skirt portion 32 and funnel portion 38. Inlet 70 includes a receiving gap 72 formed between upper edge 36 and a wall 74 forming funnel portion 38. Receiving gap 72 extends downwardly between a depending wall 76 forming cylindrical portion 34 and wall 74. Importantly, article applicator 18 is mounted in a predetermined location or position relative to tube former 30 and, specifically, relative to upper edge 36 of skirt portion 32, to cause the articles, i.e. labels, 50 being dispensed from peeler bar 64 to contact the web of packaging material at inlet 70. Article applicator 18 may be positioned anywhere along the upper edge 36 at inlet 70 around the circumference of tube former 30 to apply labels to a variety of locations on the interior surface of a package.

Preferably, peeler bar 64 is positioned so that the lower surface of labels 50 contact a portion of the web of packaging material passing over upper edge 36 and travelling in a direction away from peeler bar 64. When the label 50 contacts the web of packaging material at upper edge 36, the front portion of label 50 contacting the web of packaging material will be pulled along the feed path causing the remaining portion of the label to be pulled into contact with the web of packaging material. This pulling effect is achieved by operating the mechanism advancing the web of packaging material, i.e. sealing and advancing jaws 42, to cause the web to advance at a faster rate than the feed rate of the strip of backing material. Peeler bar 64 is preferably positioned a spaced distance from upper edge 36 which is less than the outer dimension of the label in the direction of the feed path so that the labels 50 are not dispensed from the peeler bar 64 until a portion of the front edge of the label has contacted the web material passing over upper edge 36. Since the portion of the web material contacted by the front edge of label 50 is moving away from peeler bar 64, the web of packaging material assists in dispensing label 50 from peeler bar 64. This design feature permits optimum control over the dispensing and application of label 50.

In the present embodiment, wall 74 of funnel portion 38 functions to not only partially define inlet 70 and receiving gap 72 but also to guide labels 50 into receiving gap 72 and against the web of packaging material. It is contemplated that the article applicator 18 may be positioned to deliver the articles, i.e. labels, so that the leading edge of the labels enters inlet 70 and contacts wall 74 at some point during the application process. Therefore, it is important to note that peeler bar assembly 52 is positioned so as to deliver labels to inlet 70 generally in the tube forming direction indicated by arrow A as opposed to the generally opposite direction of the web approaching upper edge 36. Wall 74 will then function to guide label 50 vertically downward into receiving gap 72 and into contact with the web of packaging material. Also, receiving gap 72 is sized with a radial width slightly larger than the combined thickness of the web and the article, i.e. label. By sizing receiving gap 72 with a close tolerance relative to the combined width of the web and label, wall 74 can be used to slightly force the label into contact with the web to the extent the label is not flush against the web. Clearly, a small amount of clearance must be provided between the interior surface of the applied labels and the outer surface of wall 74 to permit smooth effective movement of the packaging material and applied labels 50 through receiving gap 72.

As noted hereinabove, the present invention may be applicable to the application of articles of various sizes, shapes and types. For instance, article 50 may be a packaged condiment or any other item having a much greater width than the labels of the present embodiment. Accordingly, the spacing between depending wall 76 and wall 74 must be designed to create a receiving gap of sufficient size to permit movement of the web and article through the gap while ensuring contact and proper placement of the article against the web. With articles having a large width, wall 74 of funnel 38 can be formed with a shape, i.e. a vertical groove, sized to receive the article while the remainder of the wall 74 around the circumference of funnel 38 is positioned in close proximity to the web.

During setup of the apparatus, article applicator 18 is positioned in a predetermined location adjacent inlet 70 of tube former 30. Specifically, in the present embodiment, peeler bar 64 is positioned, as shown in FIG. 3, above upper edge 36 so as to dispense labels into inlet 70 and receiving gap 72 in the tube forming direction. Article applicator 18 may be positioned anywhere along the upper edge 36 at inlet 70 around the circumference of tube former 30 to apply labels to a variety of locations on the interior surface of a package. Also, multiple applicators could be utilized in various positions for applying more than one article to the interior surface of a single bag.

During operation, the advancement of the strip of articles 50 from roll 58 is synchronized to the stepwise advancement of the web of packaging material from roll 20 under the control of sealing and advancing jaws 42. The advancement of the strip of labels and the web can be synchronized by any suitable means and preferably by electronic synchronization of a drive motor associated with drive drum 69 and the operating mechanism for sealing and advancing jaws 42. For example, an electronic control unit (ECU) 80 may be used. During the synchronized operation, take-up and drive drum 69 is rotated in the clockwise direction so as to pull the backing strip of labels from supply roll 58 and through peeler bar assembly 52. Take-up and drive drum 69 rotates a sufficient degree to pull an amount of backing strip material over the peeling edge of peeler bar 64 to allow the separation of one label from the backing strip as the strip passes over the peeling edge. Article 50 is at least partially dispensed from the backing strip and delivered in the tube forming direction toward inlet 70. The leading portion of article 50 is projected over the upper edge 36 so that the underside of the article faces upper edge 36. As take-up and drive drum 69 continues to rotate, the underside of article 50 contacts the web of packaging material as the article falls onto the packaging material and is guided by wall 74 into contact with the packaging material. Wall 74 ensures contact between article 50 and the packaging material. It should be noted that the underside of articles 50 are designed to adhere to the packaging material due to the presence of an adhesive on the underside, such as a pressure sensitive, or a hot melt, adhesive. As a result, the web of packaging material has been indexed the length of one package while a label has been effectively and reliably secured to the interior surface of the tubular preform of packaging material. Simultaneously, a portion of the tubular preform corresponding to the top end of a formed package 5 is gripped and sealed by sealing and advancing jaws 42 to form a closed end tube. Sealing and advancing jaws 42 then move downward pulling the closed end tube pass the longitudinal sealer (not shown) which seals the engaged edges of the tube by applying heat and pressure to the edges and any adhesive therebetween to form a back seal along the closed-end tube. Of course, the movement of sealing and advancing jaws 42 pull the web of packaging material over upper edge 36 simultaneously with the dispensing and applying of article 50 onto the web at inlet 70. The closed-end tube is filled with product P via funnel portion 38 during the back seal formation or immediately thereafter. During the downward movement of the sealing and advancing jaws 42, and after adequate sealing has been performed, cutting device 44 is activated to sever the sealed area transversely to form a completed package 5. Subsequent to the cutting operation, sealing and advancing jaws 42 release the sealed end of the closed-end tube and move upward along the length of the closed-end tube a sufficient distance to allow the effective formation of another bag. Since the closed-end tube is now filled with product during the previous downward movement, the jaws then close to simultaneously seal the upper end of the tube above the product to form the next filled package. Simultaneously, sealing and advancing jaws 42 seal the end of the next tube and the process is repeated.

The apparatus and method of the present invention for applying an article to the interior package surface is advantageous over conventional machines for the following reasons. The present apparatus effectively minimizes the likelihood that labels will be separated from the web of packaging material after being applied by applying the article to the web at a point along the web feed path downstream of all abrupt changes in the feed path. It has been discovered that abrupt changes in the feed path, e.g. the web changing direction as it moves over a roller or upper edge 36 of tube former 30, tends to cause separation of the article from the web of packaging material. Specifically, the article applicator 18 is positioned adjacent inlet 70 of tube former 30 so as to direct articles onto the web substantially in the tube forming direction at inlet 70. As a result, the articles and web do not undergo any further abrupt changes in direction as the form-fill-seal device 14 completes its function in forming a final package 5 having article 50 attached to its interior surface. In addition, the present invention takes advantage of the wall 74 forming funnel portion 38 in using wall 74 as an article guide and applicator for guiding and assisting in the secure application of the article onto the web as it moves through receiving gap 72. As a result, the present apparatus and method results in enhanced reliability and proper article attachment to the interior surface of a flexible package while minimizing operational shutdown due to inadvertent release of the articles. Moreover, the apparatus and method of the present invention effectively permits the application of various types of articles having different sizes and shapes to the interior surface of a flexible package.

We claim:

1. An article applying apparatus for applying articles to interior package surface of a web of material, comprising:

a driving system for pulling the web of material through a feed path;

a tube former including a skirt portion and an inlet positioned along the feed path for receiving the web of material, said skirt portion including an upper edge at least partially defining said inlet, the web of material positioned on said upper edge at said inlet; and an article applying means positioned adjacent said inlet of said tube former for dispensing articles toward said inlet and applying articles onto the interior package surface of the web of material at said upper edge of said skirt portion.

2. The article applying apparatus of claim 1, further including an article guiding wall positioned at said inlet to guide the article into contact with the web of material.

3. The article applying apparatus of claim 1, wherein said feed path extends away from said upper edge in a predetermined tube forming direction, said article applying means positioned in a predetermined location to cause articles to be delivered toward said inlet substantially in said predetermined tube forming direction.

4. The article applying apparatus of claim 1, wherein said article applying means includes a peeler bar having a peeling edge positioned in close proximity to said inlet.

5. The article applying apparatus of claim 4, wherein said peeler bar is positioned in said predetermined location to form a spacing between said peeler bar and said upper edge less than an outer dimension of the article.

6. The article applying apparatus of claim 1, wherein the feed path extends toward said upper edge in a first direction, each of the articles including a planar contact side for adhering to the interior package surface of the web of material, said applying means delivering the article to said inlet with said planar contact side generally transverse to said first direction.

7. The article applying apparatus of claim 1, further including an article guiding means positioned opposite said upper edge of said tube former for guiding the article into contact with the web of material, said inlet including a receiving gap formed between said upper edge of said tube former and said article guiding means.

8. An article applying apparatus for applying articles mounted on a continuous strip of backing material to an interior package surface of a web of material, comprising:

a driving system for pulling the web of material through a feed path;

a tube former including a skirt portion having an upper edge positioned along the feed path for receiving the web of material;

a tube sealer positioned along the feed path downstream of said tube former; and an article applicator positioned adjacent said tube former in a predetermined location relative to said tube former necessary to dispense the articles from the backing material and apply each of the articles onto the web of material at said upper edge.

9. The article applying apparatus of claim 8, wherein said skirt portion includes a depending wall extending from said upper edge, further including an article guiding wall positioned opposite said depending wall to guide the article into contact with the web of material.

10. The article applying apparatus of claim 8, wherein said upper edge at least partially defines an inlet, said feed path extending away from said upper edge in a predetermined tube forming direction, said article applicator positioned in said predetermined location to cause the articles to be delivered toward said inlet substantially in said predetermined tube forming direction.

11. The article applying apparatus of claim 8, wherein said article applicator includes a peeler bar having a peeling edge positioned in close proximity to said upper edge.

12. The article applying apparatus of claim 11, wherein said peeler bar is positioned in said predetermined location to form a spacing between said peeler bar and said upper edge less than an outer dimension of the article.

13. The article applying apparatus of claim 8, wherein said upper edge at least partially defining an inlet, the feed path extending toward said upper edge in a first direction, each of the articles including a planar contact side for adhering to the interior package surface of the web of material, said article applicator delivering the article to said inlet with said planar contact side generally transverse to said first direction.

14. A method for applying an article to an interior package surface of a web of material, comprising:

pulling the web of material through a feed path;

providing a tube former including a skirt portion having an upper edge forming an inlet positioned along the feed path for receiving the web of material;

dispensing the article toward said inlet and applying the article to the interior package surface of the web at said upper edge of said skirt portion of said tube former to secure the article to the interior package surface at said inlet; and forming the web of material into a tube with the article attached to the interior package surface.

15. The method of claim 14, wherein the articles are mounted on a continuous strip of backing material, further including the steps of providing an article applicator and pulling the strip of backing material through said applicator to cause the articles to be dispensed from the strip of backing material, and pulling the web of material at a faster feed rate than a feed rate of the strip of backing material to cause each article adhering to the strip of backing material to be pulled from the strip of backing material by a pulling force of the web of material on the article.

16. The method of claim 14, wherein said feed path extends away from said tube former in a predetermined tube forming direction, further including the step of providing and positioning an article applicator in a predetermined location adjacent said tube former to cause the articles to be delivered toward said inlet substantially in said predetermined tube forming direction.

17. The method of claim 16, further including the step of sealing a portion of the tube.

18. The method of claim 16, further including the step of positioning said article applicator in said predetermined location to form a spacing between said article applicator and said tube former less than an outer dimension of the article.

* * * * *